US006481359B1

(12) United States Patent
Owens

(10) Patent No.: US 6,481,359 B1
(45) Date of Patent: Nov. 19, 2002

(54) AUTOMATIC TRACK SWITCHING SYSTEM FOR OPERABLE WALLS

(75) Inventor: N. Douglas Owens, Lynn, IN (US)

(73) Assignee: Modernfold, Inc., New Castle, IN (US)

( * ) Notice: Subject to any disclaimer, the term of this patent is extended or adjusted under 35 U.S.C. 154(b) by 0 days.

(21) Appl. No.: 09/706,041

(22) Filed: Nov. 3, 2000

Related U.S. Application Data

(60) Provisional application No. 60/163,342, filed on Nov. 3, 1999.

(51) Int. Cl.[7] ..... E01B 25/06

(52) U.S. Cl. ..... 104/130.01; 104/103

(58) Field of Search ..... 104/130.01, 103, 104/96, 195; 16/95 R, 97; 52/64

(56) References Cited

U.S. PATENT DOCUMENTS

| | | | | |
|---|---|---|---|---|
| 3,071,825 A | | 1/1963 | Ferris | |
| 3,843,995 A | * | 10/1974 | Merrill | 16/97 |
| 3,984,930 A | * | 10/1976 | Booland | 52/64 |
| 4,336,757 A | * | 6/1982 | Toder | 104/102 |
| 4,555,828 A | * | 12/1985 | Matimura | 16/95 R |
| 4,569,164 A | * | 2/1986 | Dickson | 52/64 |
| 4,642,947 A | * | 2/1987 | Dickson | 52/64 |
| 5,016,318 A | * | 5/1991 | Harris | 16/95 R |
| 5,329,857 A | | 7/1994 | Owens | |
| 5,499,671 A | | 3/1996 | Owens | |

FOREIGN PATENT DOCUMENTS

| | | |
|---|---|---|
| EP | 0408006 | 1/1991 |

OTHER PUBLICATIONS

Copy of International Search Report dated Feb. 02, 2001 for PCT/US00/3044 which claims priority to U.S. application No. 09/706,041.

* cited by examiner

*Primary Examiner*—S. Joseph Morano
*Assistant Examiner*—Lars A. Olson
(74) *Attorney, Agent, or Firm*—Baker & Daniels

(57) ABSTRACT

An automatic track switching stem is provided for a movable wall system having multiple wall panels (22) supported by and movable along multiple paths defined by multiple track sections (26–32) to predetermined configurations. The track switching system is operable by manually pushing each of the wall panels (22) along the track sections. Multiple switch assemblies (50, 70, 80) automatically direct each wall panel to an appropriate position based upon diverter means (115 et al.) associated with the trolley assemblies (85 et al.) for each wall panel. The switch assemblies include an array of vertically oriented plates (e.g., 255, 256, 257) that are each offset at different lateral distances from the track path. The diverter means for each trolley assembly includes a vertical pin (e.g., 123) that is situated at a predetermined lateral distance to engage a selected one of the switching plates. In one embodiment, each panel includes a lead trolley and a trailing trolley, with the vertical pin for each associated diverter means having different heights. The switching plates for different switch assemblies have heights calibrated to be engaged by only one of lead or trailing trolley.

10 Claims, 12 Drawing Sheets

AUTOMATIC TRACK SWITCHING SYSTEM FOR OPERABLE WALLS

REFERENCE TO RELATED APPLICATIONS

The present application claims priority to co-pending Provisional Application, Serial No. 60/163,342, filed on Nov. 3, 1999.

BACKGROUND OF THE INVENTION

The present invention pertains to operable walls movable to partition large rooms into smaller rooms, and, in particular, to a system for switching operable wall panels between different tracks.

Operable walls or partitions, also known as movable wall panel systems, find useful application in a variety of venues, such as classrooms, offices, convention facilities and hospitals. In these venues, the operable walls can be moved along tracks from which they are suspended to efficiently compartmentalize interior space into a multitude of separate, smaller rooms.

One existing problem with operable walls manifests itself when a multitude of wall-forming panels stacked at a single location need to be moved along multiple, intersecting tracks within a larger room so as to compartmentalize that single, larger room into three or more smaller rooms. In many circumstances, at each track intersection, each panel needs to be routed to a specific track to achieve the proper appearance. In particular, frequently the panels are designed to be positioned in a certain wall-forming location or orientation in order for the panels to be properly utilized. For example, each panel can have different properties, such as colors, textures or features, on its opposite wall-forming sides. These properties allow each smaller room formed when the larger room is compartmentalized to have, for example, walls that are differently colored than the walls of the other smaller rooms. Routing panels onto the wrong track can result in mismatched walls. Previously, the process of setting up the walls correctly could have been a time-consuming and frustrating task unless the laborers charged with moving the panels from a storage or stacked arrangement to an operational arrangement were mindful of where the panels needed to go.

In order to facilitate the process of directing panels into the right track at a track intersection, some known prior art designs have utilized track-mounted diverter or guide plates at the track intersections which cooperate with complementarily shaped diverter members mounted on the panel trolleys. In operation, as a panel reaches a track intersection, the engagement of the diverter elements on the track and trolley automatically directs that panel into the proper track. As a result, the amount of attention laborers need to give to the sequence in which the panels are moved is reduced.

In some cases, the trolleys have been equipped both with one diverter member that extends above the wheels of the trolley to engage a diverter plate mounted to the underside of a top plate of a switch, and a second upstanding diverter member, mounted to a plate laterally extending from the trolley below the wheels, that engages a diverter plate mounted to the underside of the bottom plate of the switch. However, these diverter plate/member designs offer only a limited number of switching options, which number is insufficient for some complicated wall system designs that have a large number of track intersections through which the panels must be selectively moved.

Another type of operable wall utilizes an electric switching station to direct or switch panels to the appropriate track.

The switching station includes a rotatable platter mounted at the intersection of multiple tracks. The platter is electrically operable to rotate between multiple positions, and the platter connects together different track sections at each position. One disadvantage of this system is that although it allows numerous track sections to be selectively interconnected to achieve the proper track path for a movable panel, the platter requires a person to control the track rotation. As a result, human error can result in the wrong panels being routed to the various tracks, or, for that matter, the panel switching system not being used at all. Still further, the electric switching system is relatively expensive, and also requires, due to the size of the switching system platter, special panels to be provided to close off the wall after being extended.

Thus, it would be desirable to provide a track switching system which overcomes these and other problems of the prior art.

SUMMARY OF THE INVENTION

The present invention provides an operable wall with a track switching system that automatically routes panels between intersecting tracks. The switching system includes diverters positioned on trolleys at one of several lateral positions which engage switch plates mounted to the switch assembly.

One advantage of the present invention is that it provides a track switching system that automatically routes separate panels of a movable wall panel system to the appropriate track to be used in compartmentalizing one room into smaller rooms.

Another advantage of the present invention is that the track switching system works mechanically and without human intervention.

Still another advantage of the present invention is that the track switching system does not require electrical power or controls, thereby reducing complexity as well as expense.

Still another advantage of the present invention is that the track switching system enables a wide variety of track configurations and intersections to be used.

Still another advantage of the present invention is that the track switching system permits all of the panels to be stored on one side of the track without the need for offset switches.

BRIEF DESCRIPTION OF THE DRAWINGS

The above mentioned and other advantages and objects of this invention, and the manner of attaining them, will become more apparent and the invention itself will be better understood by reference to the following descriptions of embodiments of the invention taken in conjunction with the accompanying drawings, wherein:

FIG. 2 is a front view of a trolley equipped with diverter elements for the switching system of the present invention;

Figure 1:
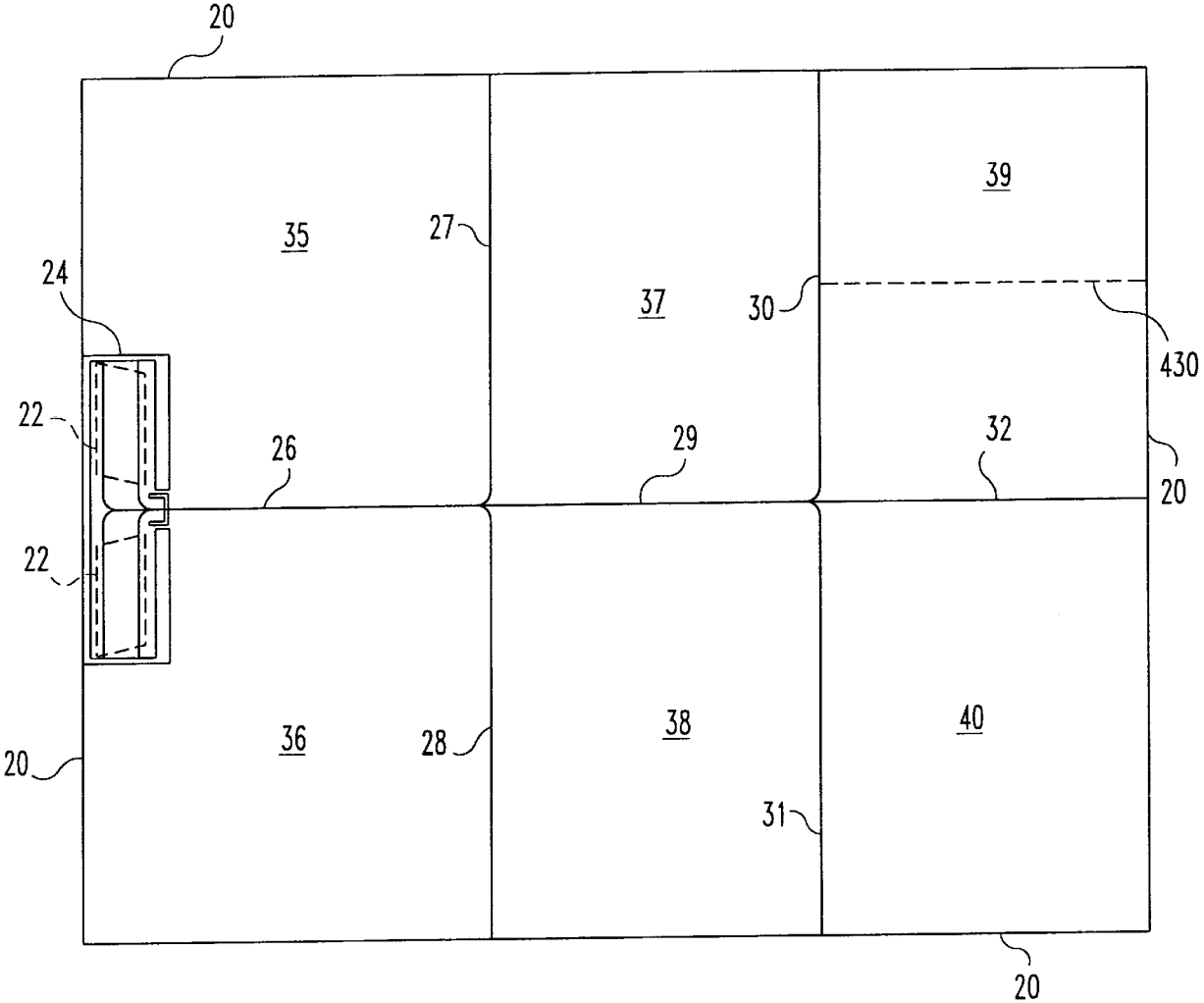
FIG. 1 is a diagrammatic top view of an operable wall that employs a track switching system of the present invention.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Figure 1A:
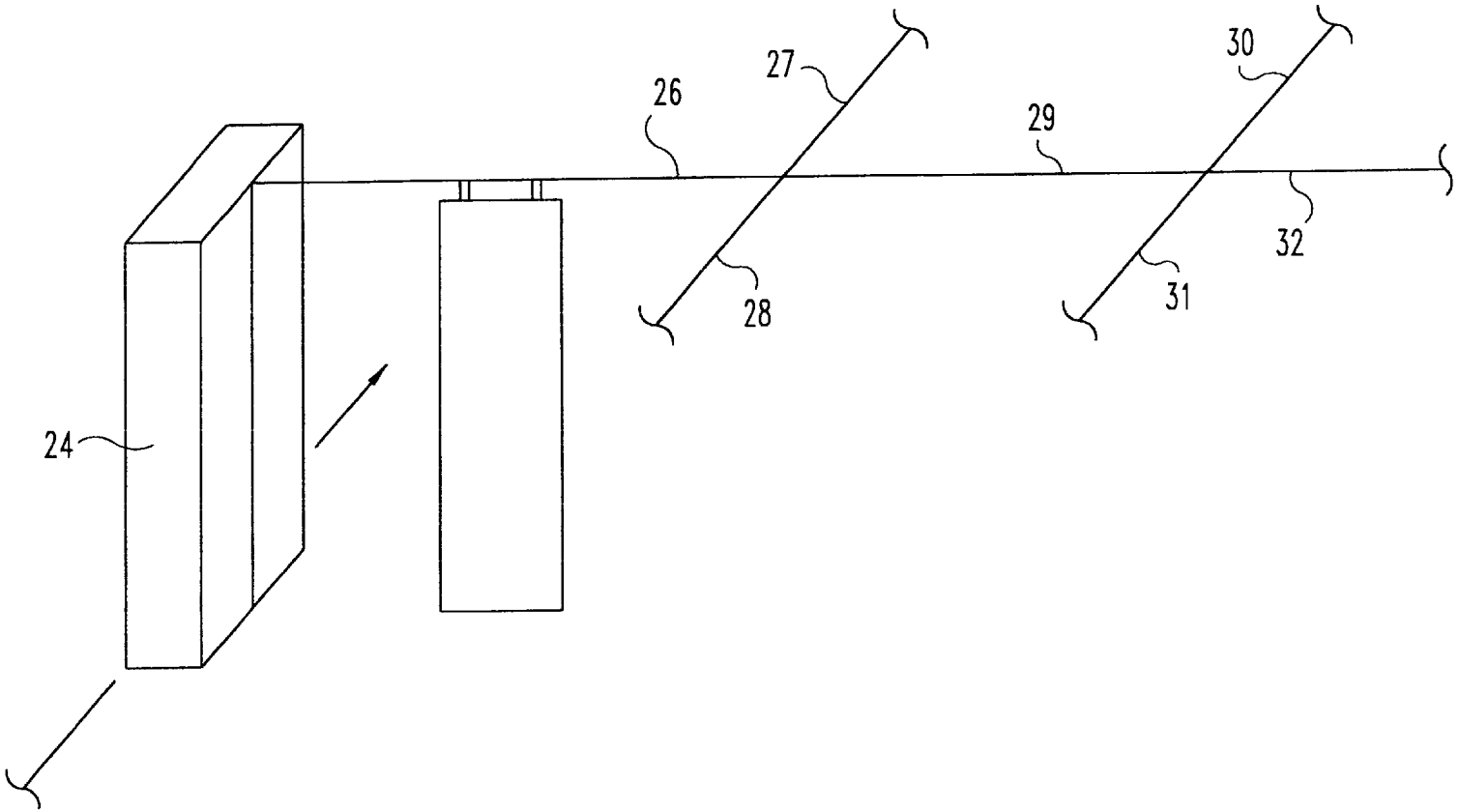
FIG. 1A is a diagrammatic perspective view of the operable wall of FIG. 1.

Referring now to FIGS. 1 and 1A, there is diagrammatically shown a top view and a perspective view of a movable wall panel system including an automatic track switching system of the present invention. The movable wall panel system serves to selectively compartmentalize a single, large room 20 into smaller rooms or areas. The operable wall includes a multitude of panels that extend from the floor to the ceiling of room 20, which panels are shown in FIG. 1 in dashed lines at 22 in a stacked or storage position within a housing abstractly indicated at 24. In FIG. 1A, one of the panels 22 is shown being moved to a wall-forming location. Although shown as being within room 20, housing 24 typically is located directly adjacent to and outward of a side wall of room 20 as a specially designed pocket room. Except for the trolleys that provide for the panel suspension from the ceiling mounted track sections, wall panels 22 may be of any conventional construction. None of the panels 22 are hinged to adjacent panels in the inventive panel system, as the track switching system of the present invention uses panels that are each separately movable along the track between an operational, wall-forming position and a storage position.

Panels 22 are movable along track segments mounted in the ceiling which form intersecting track sections 26, 27, 28, 29, 30, 31 and 32. Track sections 26–32 are designed such that when panels 22 are all in their wall-forming positions, room 20 is compartmentalized into six smaller rooms or areas 35, 36, 37, 38, 39 and 40. This track configuration is merely illustrative and not intended to be limiting as the inventive track switching system may be employed with more complicated or less complicated tracks, including intersecting tracks that serve to compartmentalize a room into different numbers of smaller room or differently shaped rooms. In addition, the shown track configuration can be used in an even larger room than room 20, which larger room is equipped with one or more additional operable wall panel systems that are similar to the shown system and which form walls in alignment with the walls formed by the shown wall panel system to provide suitable room compartmentalization.

Figure 2:
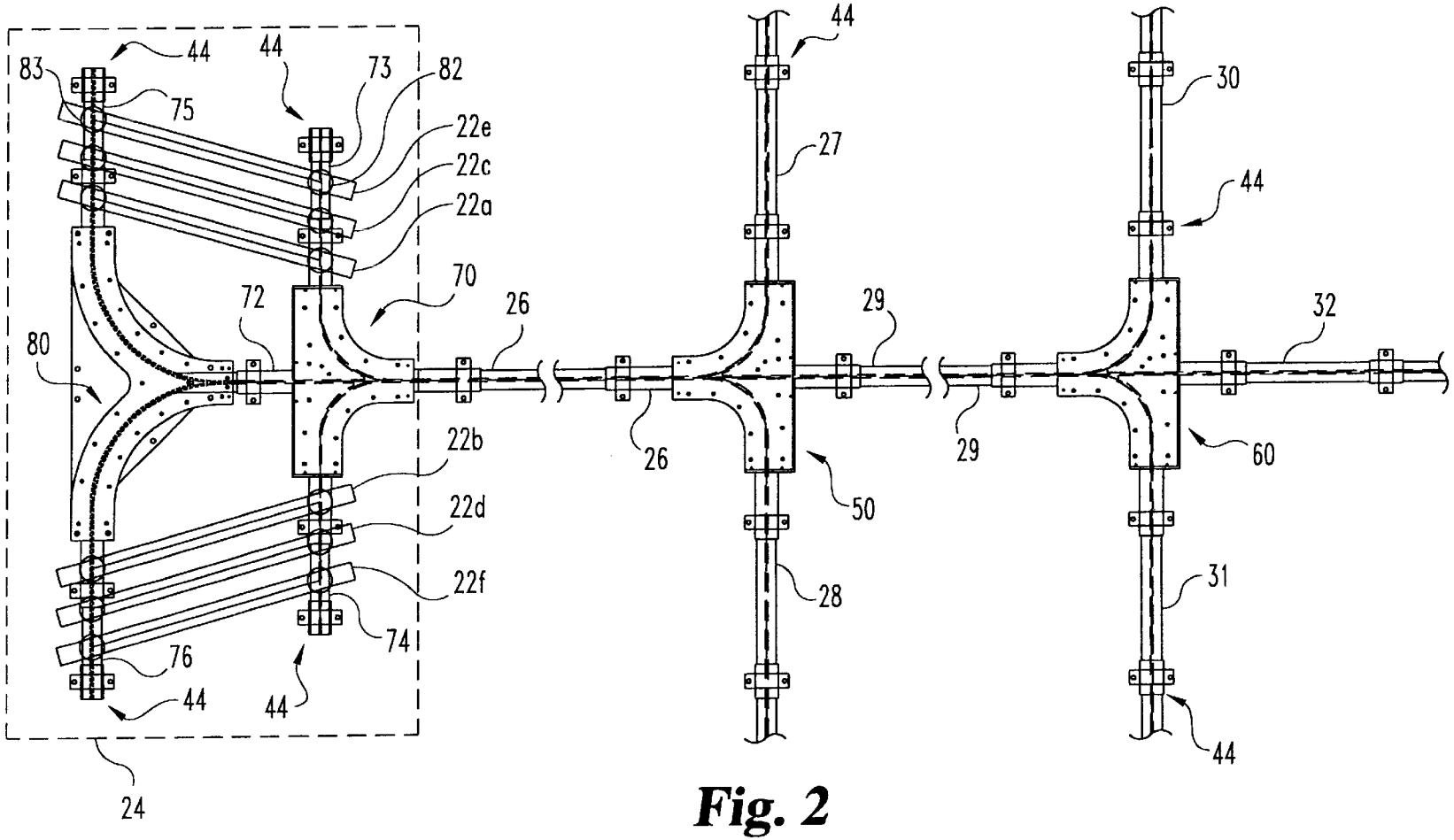
FIG. 2 is a partial, diagrammatic top view of the operable wall of FIG. 1, wherein the track and track switching system are shown in additional detail.

Referring now to FIG. 2, portions of the operable wall of FIG. 1 are shown in a top view. Track sections 26–32 are of a conventional design suitable for use with the type of trolley employed with the panels. As described below, different types of trolleys may be used within the scope of the invention, and the track construction will be changed in a corresponding fashion to provide proper a suitable track and trolley combination. In the illustrated embodiment, track sections 26–32 are made of steel beams which are generally square in vertical cross-section. The wheels of the trolley ride along the bottom wall of the track section, and a slot centered in that bottom wall which extends longitudinally along the track section length permits passage of the pendant trolley bolt that attaches to the top of a panel 22. Track sections 26–32 are mounted to the ceiling support structure by means of hanger brackets of conventional design, generally shown at 44, positioned at spaced intervals along the lengths of the track sections.

A switch assembly, generally designated 50, serves as an intersecting track section for track sections 26–29 and is operably connected to each of track sections 26–29. Switch assembly 50 is mounted to the ceiling support structure and, as described further below, is designed to cooperate with diverter elements mounted on the panel trolleys to direct panels being moved along track section 26 in a wall-forming direction into one of track sections 27, 28 and 29. Another switch assembly, generally designated 60, serves as the intersection of track sections 29–32 to which it is operably connected. Switch assembly 60 also is mounted to the ceiling support structure and is designed to cooperate with diverter elements mounted on the panel trolleys to direct panels being moved along track section 29 in a wall-forming direction into one of track sections 30, 31 and 32.

The stacking of panels 22 within housing 24 is achieved through the use of switch assemblies 70 and 80 that are interconnected by track segment 72 and which are mounted to the ceiling support structure. Switch assembly 70 is operably connected to track section 26, as well as to panel stacking track segments 73 and 74 mounted to the ceiling support structure by hanger brackets 44. Switch assembly 80 is connected to panel stacking track segments 75 and 76 mounted to the ceiling support structure by hanger brackets 44.

Panels 22 are stacked along track segments 73–76 when stored within housing 24. The length of track segments 73–76 is a function of the number of panels to be stacked, which in turn is a function of the length of the walls formed by the panels when moved to their wall-forming positions. In FIG. 2, only six panels are shown to facilitate illustration, and these panels are designated as 22*a*, 22*b*, 22*c*, 22*d*, 22*e* and 22*f*. Each of these panels represents multiple panels of a similar type, with the types being distinguished herein based solely on the configuration of their trolleys. Specifically, and while the panels may otherwise be similar in most respects, as described below the trolleys of panel type 22*a* differ from the trolleys of panel type 22*b–f*, which in turn have trolleys that differ from each other. When the operable wall is fully extended, panels of the type 22*a* are aligned along the entire length of track section 30, panels of the type 22*b* are aligned along the entire length of track section 31, panels of the type 22*c* are aligned along the entire length of track section 27, panels of the type 22*d* are aligned along the entire length of track section 28, and panels of the type 22*e* and 22*f* are aligned along the entire length of track sections 26, 29 and 32. Naturally, the number of panels each of panels 22*a*, 22*b*, 22*c*, 22*d*, 22*e* and 22*f* represents can differ as it is dependent upon the length of the walls being formed, and it is not material to the present invention.

Each of panels 22 is suspended from the track system by two trolleys, namely a lead trolley and a trailing trolley, positioned proximate opposite ends of that panel. As used herein, lead and trailing are referenced with respect to the trolley position during movement of the panels from a stacked position to a wall-forming position. The lead or front trolleys of panels 22*a*, 22*b*, 22*c*, 22*d*, 22*e* and 22*f*, when such panels are stacked, are disposed along track segments 73 and 74, and the trailing or back trolleys of the panels when stacked are disposed along track segments 75 and 76. For example, and with reference to stacked panel 22*e*, a lead trolley generally represented at 82 suspends the panel from track section 73, and a trailing trolley generally represented at 83 suspends the panel from track section 75.

Figure 4:
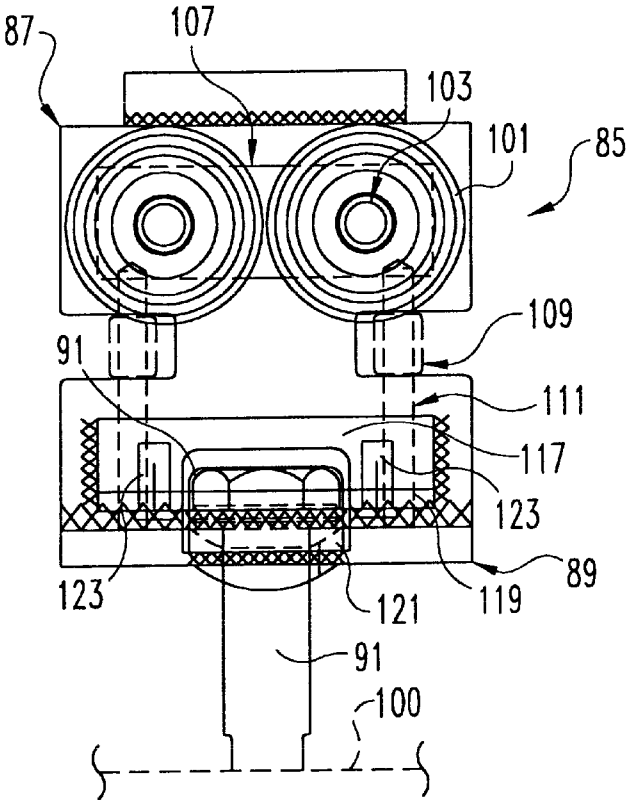
FIG. 4 is a left sided view of the trolley with diverter elements of FIG. 2.

The automatic track switching system of the present invention employs switch or diverter elements mounted to the trolleys of panel 22. The overall form of the trolleys to which such diverter elements are attached may be selected from one of the many known designs. As a result, the term trolley is used generally herein, and is intended to encompass devices, including wheeled carriages and carriers, of all types that are operably connected to and movable along various tracks. One such trolley is shown in FIG. 2 and FIG. 4 and is generally designated 85.

Trolley 85 includes a vertically oriented trolley plate 87 to which is welded bottom plate 89. Pendant trolley bolt 91, which inserts through a pair of thrust races 93, thrust needle bearing 95, and pivot washer 97, extends through bottom plate 89 and is secured to the top section of a movable wall panel, abstractly shown in dashed lines at 100, in a well known fashion. Four rotatable trolley wheel assemblies 101 that roll along the track bottom wall are mounted on trolley axles 103 that extend through wheel spacers 105, spacer plates 107 and trolley plate 87. Guide bushings 109 located in notches formed in trolley plate 87 are rotatably mounted on pins 111 and serve to reduce friction between trolley 85 and the track gap along which it rides.

The switch or diverter elements mounted to trolley 85 includes a center diverter 113 that extends upwardly beyond the wheel assemblies 101 in order to engage complementary diverter or guide plates provided on the track above the trolley. Center diverter 113 is provided in the form of a rigid plate preferably fixedly attached, such as by welding, to the upper edge of trolley plate 87. Rather than the shown plate, other diverter element shapes, including one or more upstanding pins, may be employed. The center diverter may also be formed integral with and as an extension of the trolley plate 87.

A second diverter element, generally indicated at 115 (FIG. 3), projects laterally (i.e. in a direction generally perpendicular to the directions in which the trolley 85 moves along the track during wall forming and wall stacking) from the trolley plate 87 at a point below the wheel assemblies 101. Side diverter element 115 is preferably formed from an L-shaped steel plate having a short leg flange 117 and a long leg flange 119. Flange 117 is attached, such as by welding, to trolley plate 87. Flange 119 is disposed at a right angle to flange 117 and extends laterally beyond wheel assemblies 101. Notches provided in flanges 117 and 119 accommodate the presence of the head of trolley bolt 91. Steel block 121 is welded to flange 119 and bottom plate 89 to provide rigidity to side diverter element 115.

Extending vertically upward from flange 119 are a pair of diverter pins 123. Pins 123, which function to engage complementary guide plates provided on the track below the trolley, are longitudinally spaced along flange 119 and aligned so as to be equi-distant from trolley plate 87. Diverter pins 123 are shown as being preferably formed of generally cylindrical, clevis pins that fit through circular openings in flange 119. Rather than the shown pin configuration, one or more different diverter elements, such as plates, may be substituted for the cylindrical pins.

Figure 3:
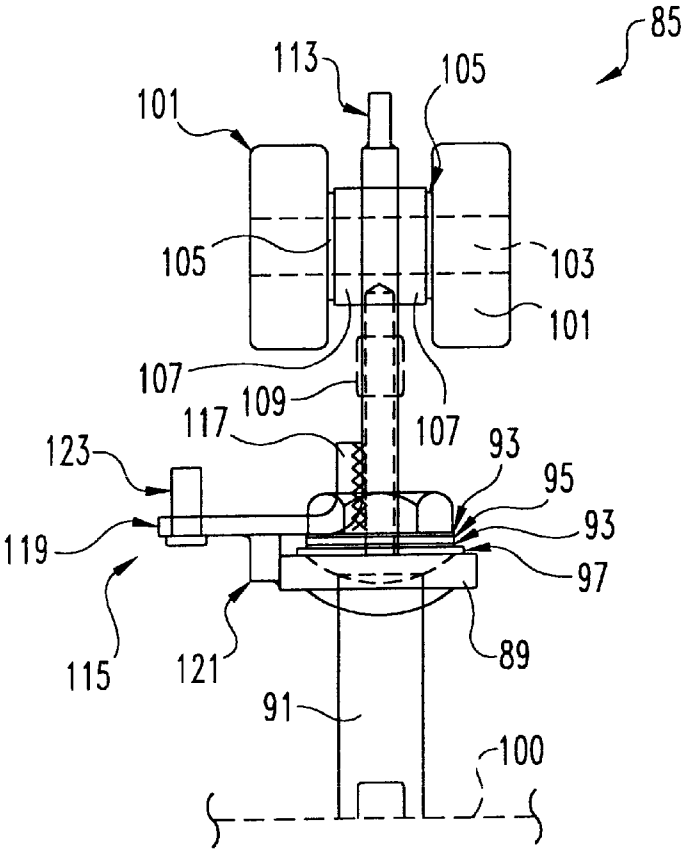

The design of trolley 85 shown in FIGS. 3 and 4, other than the configuration of the two diverter elements shown, is suitable for use as the basic design for the trolleys of panels 22*a*, 22*b*, 22*c*, 22*d*, 22*e* and 22*f*. The difference between trolleys configured for use with these six panel types lies solely in the diverter element(s) setups. While all of the trailing and lead trolleys include side diverter elements, in the illustrated embodiment the side diverter elements are positioned on either the left side or right side of the trolley, and the upstanding pins on the side diverter element for each trolley are located at only one of three different lateral positions relative to and on each side of the trolley centerline. In addition, each of the trailing trolleys includes a center diverter, while none of the lead trolleys includes such a diverter.

More specifically, these diverter elements are abstractly shown and further described with reference to FIGS. 5–10 and 11–16. FIGS. 5–10 show diagrammatic front views of trailing trolleys of the six panel types, and FIGS. 11–16 show diagrammatic front views of lead trolleys of the six panel types. As used herein, the front view is the view of the trolley from the perspective of a person looking to the left in FIG. 2, such as the view to a person stationed at switch assembly 50 of a trolley moving from housing 24 toward that switch assembly along track section 26.

Figures 5, 6, 7, 8, 9, 10:
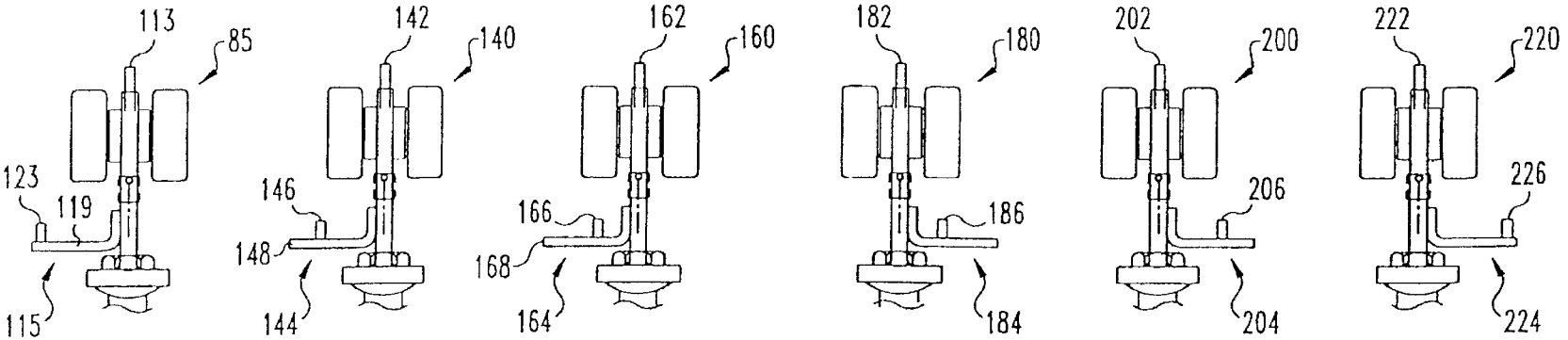
FIGS. 5–10 are diagrammatic front views of the different trolley configurations for the trailing trolleys of six different types of panels employed in the embodiment of the track switching system of the present invention shown in FIG. 1.
Figures 11, 12, 13, 14, 15, 16:
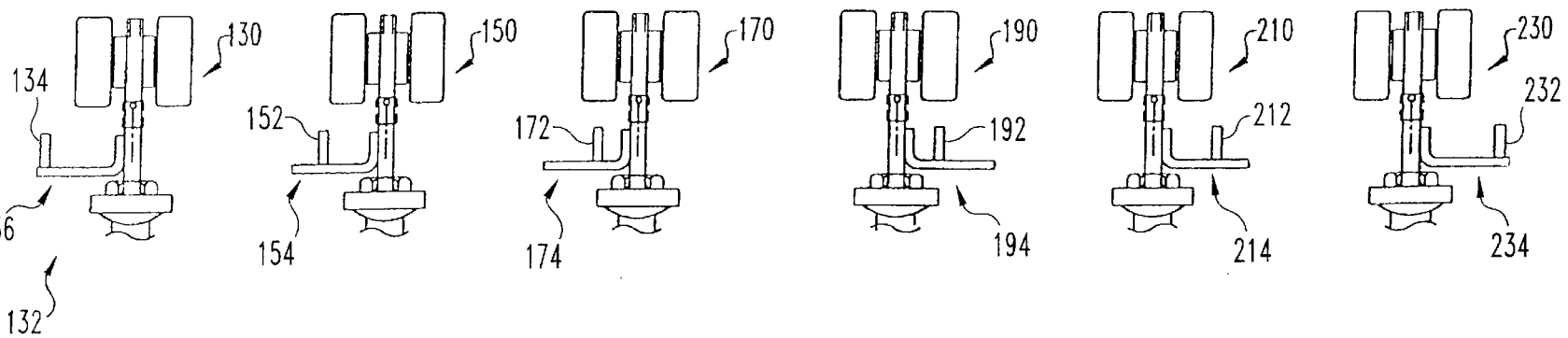
FIGS. 11–16 are diagramatic front views of the different trolley configuration the lead trolleys that are used with the trailing trolleys of FIGS. 5–10.

FIG. 5 shows a trailing trolley used with panel type 22*d*. FIG. 5 shows in a more diagrammatic way the exact trolley that is shown in FIG. 2, and therefore this trolley includes a center diverter 113, and a side diverter element 115 on the left side of the trolley. Both of the aligned, upstanding pins 123 are positioned at a most laterally outward position on flange 119, and are of a first or reduced vertical height. FIG. 11 shows a lead trolley, generally designated 130, used with panel type 22*d*. Trolley 130, while lacking a center diverter, includes a side diverter element, generally designated 132, on the left side of the trolley. A pair of longitudinally spaced diverter pins 134 are positioned at the most laterally outward position on flange 136, and are of a standard height that is greater than the height of pins 123.

FIG. 6 shows a trailing trolley, generally designated 140, used with panel type 22*b*. Trolley 140 includes a center diverter 142 and a side diverter element, generally designated 144, on the left side of the trolley. Upstanding pins 146 positioned at a laterally intermediate position on flange 148 of side diverter element 144 are of the first or reduced vertical height. Other than the lateral positioning of its side diverter element pins, trolley 140 is structurally identical to the trolley of FIG. 5. FIG. 12 shows a lead trolley, generally designated 150, used with panel type 22*b*. Upstanding pins 152 of a side diverter element 154 positioned on the left side of the trolley are positioned at a laterally intermediate position and are of the standard height. Other than the lateral positioning of its side diverter element pins, trolley 150 is structurally identical to the trolley of FIG. 11.

FIG. 7 shows a trailing trolley, generally designated 160, used with panel type 22*f*. Trolley 160 includes a center diverter 162 and a side diverter element, generally designated 164, on the left side of the trolley. Upstanding pins 166 of the reduced height are positioned at a laterally inward position on flange 168. Other than the lateral positioning of its side diverter element pins, trolley 160 is structurally identical to trolley 140. FIG. 13 shows a lead trolley, generally designated 170, used with panel type 22*f*. Upstanding pins 172 of a side diverter element 174 positioned on the left side of the trolley are positioned at a laterally inward position and are of the standard height. Other than the lateral positioning of its side diverter element pins, trolley 170 is structurally identical to trolley 150.

FIG. 8 shows a trailing trolley, generally designated 180, used with panel type 22*e*. Trolley 180 is identical to trolley 160 in overall structure, but is arranged on the track backward, or in a turned around fashion, relative to trolley 160 such that the side diverter element is located on the right side of the trolley. Trolley 180 includes a center diverter plate 182, and a side diverter element 184 with upstanding pins 186 positioned at a laterally inward position. FIG. 14 shows a lead trolley, generally designated 190, used with panel type 22*e*. Trolley 190 is identical to trolley 170 in overall structure, but is arranged on the track backward relative to trolley 170 such that the side diverter element is located on the right side of the trolley. Trolley 190 includes a side diverter element 194 with upstanding pins 192 positioned at a laterally inward position.

FIG. 9 shows a trailing trolley, generally designated 200, used with panel type 22*a*. Trolley 200 is identical to trolley 140 in overall structure, but is arranged on the track backward relative to trolley 140 such that the side diverter element is located on the right side of the trolley. Trolley 200 includes a center diverter plate 202, and a side diverter element 204 with upstanding pins 206 positioned at a laterally intermediate position. FIG. 15 shows a lead trolley, generally designated 210, used with panel type 22*a*. Trolley 210 is identical to trolley 150 in overall structure, but is arranged on the track backward relative to trolley 150 such that the side diverter element is located on the right side of the trolley. Trolley 210 includes a side diverter element 214 with upstanding pins 212 positioned at a laterally intermediate position.

FIG. 10 shows a trailing trolley, generally designated 220, used with panel type 22*c*. Trolley 220 is identical to trolley 85 in overall structure, but is arranged on the track backward relative to trolley 85 such that the side diverter element is located on the right side of the trolley. Trolley 220 includes a center diverter plate 222, and a side diverter element 224 with upstanding pins 226. positioned at a laterally outward position. FIG. 16 shows a lead trolley, generally designated 230, used with panel type 22*c*. Trolley 230 is identical to trolley 130 in overall structure, but is arranged on the track backward relative to trolley 130 such that the side diverter element is located on the right side of the trolley. Trolley 230 includes a side diverter element 234 with upstanding pins 232 positioned at a laterally outward position.

Figure 17:
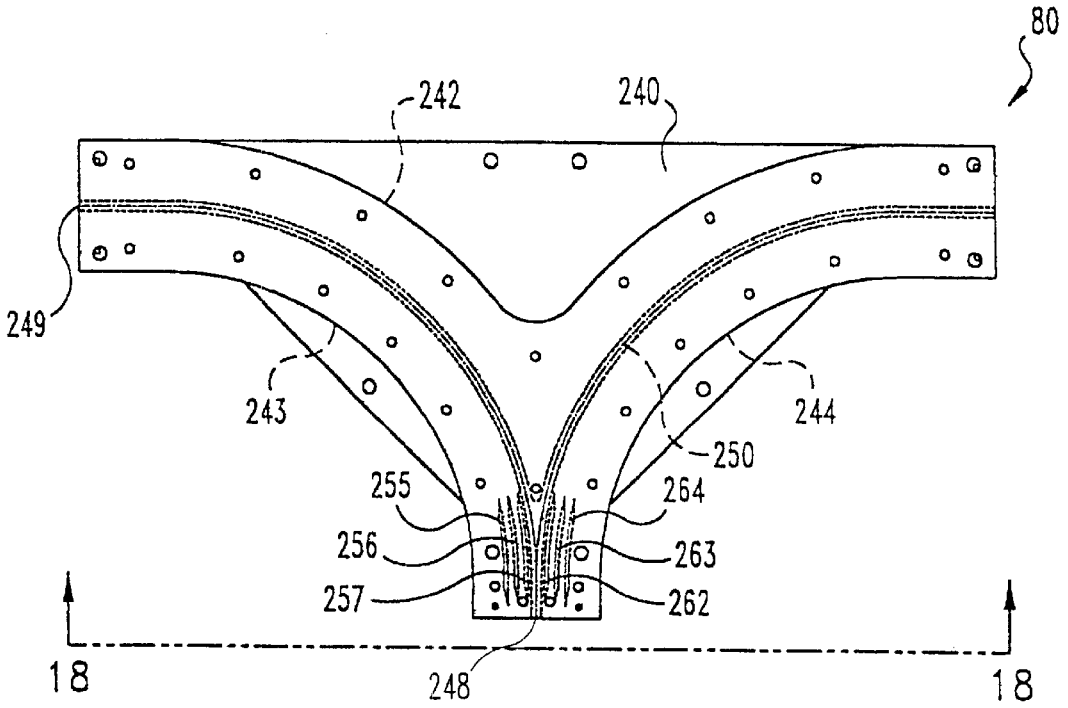
FIG. 17 is a top view of a switch assembly from FIG. 2, shown removed from the remainder of the track, which serves to direct trailing trolleys to their proper track sections during wall panel stacking.
Figure 18:
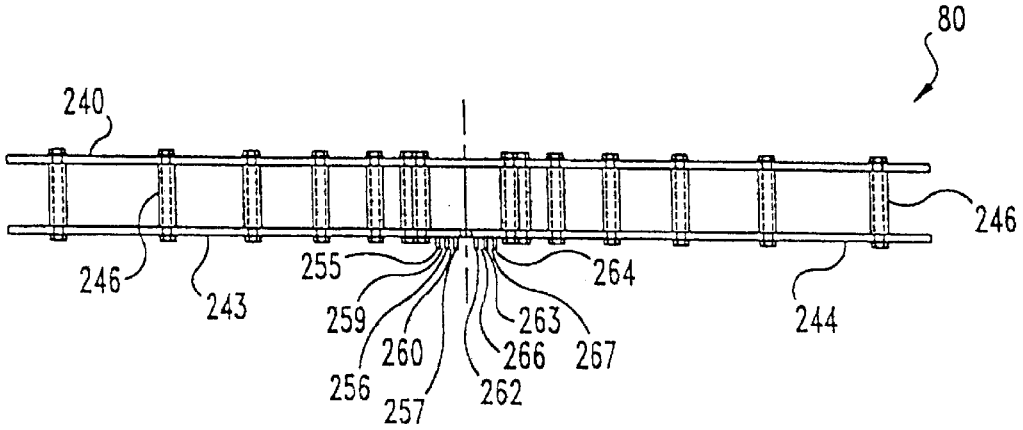
FIG. 18 is a front view, taken along line 18—18 in FIG. 17, of the switch assembly of FIG. 17.

The switch assemblies particularly designed for use in conjunction with the panel suspending trolleys of FIGS. 5–16 are shown in greater detail in FIGS. 17–25. With reference now to FIGS. 17 and 18, the switch assembly 80 that during wall stacking cooperates with the trolley diverter elements to route the trailing trolleys to their proper track sections is shown in top view and front view, respectively. In the illustrated embodiment, switch assembly 80 is formed from a single top plate 240 and three bottom plate sections 242, 243 and 244. Top plate 240 is suspended from a support structure with conventional fasteners in order to mount switch assembly 80 in the ceiling of room 20. Plate sections 242–244 are each connected to top plate 240 in a vertical spaced-apart relationship in a well-known manner with a plurality of bolt and nut type fasteners that extend through tubular steel spacers 246 sandwiched between the various switch plates. The portions of these plate-connecting fastener assemblies that lie above the upper surface of top plate 240 are not shown in FIG. 17 for purposes of illustration.

Plate sections 243 and 244 are horizontally spaced apart to provide a track path 248 into which enter trolleys being routed into switch assembly 80 in a panel stacking direction. Plate sections 242 and 243, and plate sections 244 and 242, are horizontally spaced apart to provide arcuate track paths or slots 249 and 250, respectively. Track paths 248, 249 and 250, which provide the spaces through which extend the pendant bolts of the trolleys when the trolleys move or roll along the upper surface of plate sections 242–244, are aligned with the track paths of track sections 72, 76 and 75, respectively.

Diverters or guides used to selectively route trolleys passing along track path 248 into either track path 249 or 250 include a series of elongate plates mounted on either side of track path 248. As shown in FIG. 17, three elongate and arcuate guide plates 255, 256 and 257 are fixedly attached, such as by welding, to the underside of bottom plate section 243 proximate track path 248. Guide plates 255–257 are evenly horizontally spaced to provide channels 259 and 260. Three elongate, arcuate guide plates 262, 263 and 264 are similarly attached to the underside of bottom plate section 244 to provide channels 266 and 267. The ends of the guide plates are pointed to aid in routing diverter pins into the appropriate channel or space as described further below.

Referring to FIG. 18, in conjunction with the height of the diverter pins of the side diverters of the trolleys, each of guide plates 255–257 and 262–264 are made sufficiently tall so as to project down from the respective bottom plate section to a height at least slightly below the tops of the upstanding pins of the side diverter elements of the trailing trolleys. As so configured, the diverter pins must either enter one of the channels 259, 260, 266 and 267, or enter the spaces laterally outward of guide plates 255 and 264, when the trolleys pass along track path 248. Specifically, when the trailing trolleys shown in FIGS. 5–7 are separately routed through track path 248 in a wall-stacking direction, diverter pin 123 passes along the outer side of guide plate 255, diverter pin 146 moves within channel 259, and diverter pin 166 moves within channel 260, thereby routing these trolleys into track path 249. Similarly, when the trailing trolleys shown in FIGS. 8–10 are separately routed through track path 248 in a wall-stacking direction, diverter pin 226 passes along the outer side of guide plate 264, diverter pin 206 moves within channel 267, and diverter pin 186 moves within channel 266, thereby routing these trolleys into track path 250.

Although guide plates 257 and 262 are shown as having a slightly lesser height than the heights of guide plates 255, 256, 263 and 264 for clearance purposes, all of guide plates 255–257 and 262–264 may be of an identical height, or for that matter could all be of different heights, so long as each plate is sufficiently tall so as to engage the appropriate trolley diverter pin during use.

Figure 19:
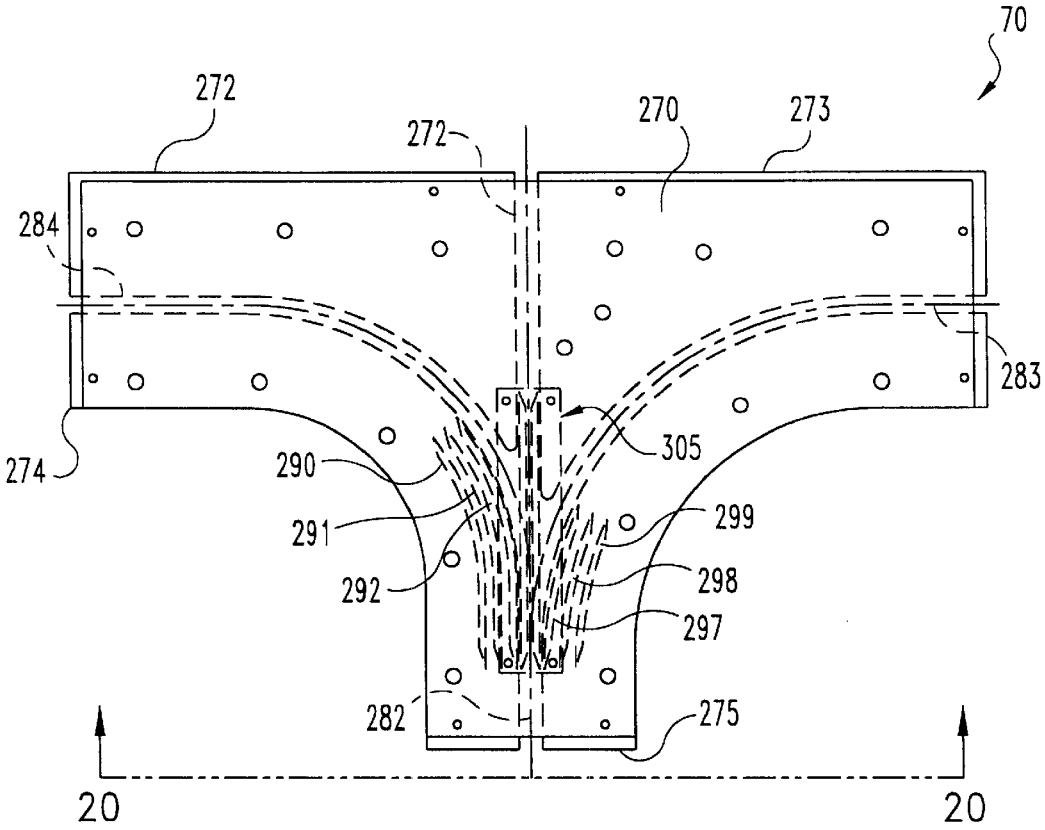
FIG. 19 is a top view of a switch assembly from FIG. 2, shown removed from the remainder of the track, which serves to direct lead trolleys to their proper track sections during wall panel stacking.
Figure 20:
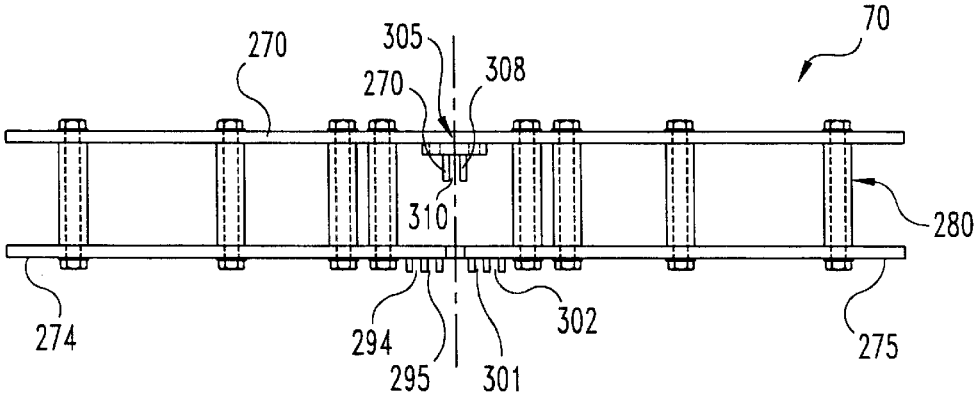
FIG. 20 is a front view, taken along line 20—20 in FIG. 19, of the switch assembly of FIG. 19.

With reference now to FIGS. 19 and 20, the switch assembly 70 that during wall stacking cooperates with the trolley diverter elements to route the lead and trailing trolleys to their proper track sections is shown in top view and front view, respectively. In the illustrated embodiment, switch assembly 70 is formed from a single top plate 270, mounted in the room ceiling, and four bottom plate sections 272, 273, 274 and 275. Bottom plate sections 272–275 are each connected to top plate 270 in a vertical spaced-apart relationship via spacing fasteners indicated at 280.

Bottom plate sections 274 and 275 are horizontally spaced apart to provide a track path 282 into which enter trolleys being routed in a panel stacking direction. Plate sections 273 and 275, and plate sections 272 and 274, are horizontally spaced apart to provide arcuate track paths 283 and 284, respectively, in communication with track path 282. Plate sections 272 and 273 are horizontally spaced apart to provide a linear track path 285 in communication and aligned with track path 282. Track paths 282, 283, 284 and 285 are aligned with the track paths of track sections 26, 73, 74 and 72, respectively.

In order to maintain the downstream ends of track paths 283 and 284 in alignment with each other while at the same time having the upstream ends of these track paths be staggered along the track path 282 to avoid relatively large gaps between the bottom plates, arcuate paths 283 and 284 are formed with different radiuses. One suitable radius for the tighter turn for the trolley is about eight inches, while a suitable radius for the more gentle turn can be about twelve inches. Other radiuses of curvature for either turn of the illustrated trolley, such as 16, or 20, or 24 inches, and preferably greater than eight inches, may be employed. Different trolleys may allow use of still different radiuses of curvature, including larger and smaller radii.

Guides used to selectively route lead trolleys passing along track path 282 into either track path 283 or 284 include a series of plates mounted to bottom plate sections 274 and 275 on either side of track path 282. Arcuate guide plates 290, 291 and 292 are fixedly attached to the underside of bottom plate section 282 to form channels 294 and 295. Three arcuate guide plates 297, 298 and 299 are similarly attached to the underside of bottom plate section 275 to provide channels 301 and 302. Each of guide plates 290–292 and 297–299 is shorter than guide plates 255–257 and 262–264 of switch assembly 80. Specifically, guide plates 290–292 and 297–299 are made sufficiently tall so as to project down from the respective bottom plate section to a height slightly below the tops of the upstanding pins of the side diverter elements of the lead trolleys, but not so tall as to extend below the tops of the shorter pins of the side diverter elements of the trailing trolleys. As a result, during operable wall stacking when the trolleys are passed through track path 282, while the diverter pins of the trailing trolleys do not engage guide plates 290–292 and 297–299 so that these guide plates do not interfere with the motion of the trailing trolleys, the diverter pins of the lead trolleys are guided by these plates. Diverter pin 134 passes along the outer side of guide plate 290, diverter pin 152 moves within channel 294, and diverter pin 172 moves within channel 295, thereby routing the trolleys of FIGS. 11–13 into track path 284. Diverter pin 232 passes along the outer side of guide plate 299, diverter pin 212 moves within channel 302, and diverter pin 192 moves within channel 301, thereby routing the trolleys of FIGS. 14–16 into track path 283.

Figure 21:
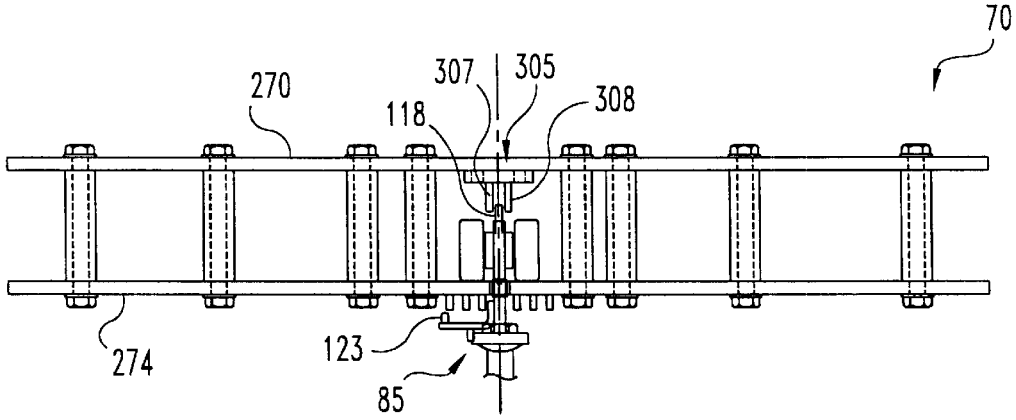
FIG. 21 is a front view similar to FIG. 20, wherein a trailing trolley is shown passing through the switch assembly.

In order to ensure the trailing trolleys being moved in a stacking direction through track path 282 continue into track path 285 and not track paths 283 and 284, an upper guide, generally designated 305, is fixed to the underside of top plate 270 with conventional fasteners. Upper guide 305 continuously extends between a point above track path 282 and a point above track path 285. Upper guide 305 includes a pair of downwardly extending flanges 307, 308 that run along its track extending length. Flanges 307 and 308 vertically extend down sufficiently to define a channel 310 into which the center diverter of each of the trailing trolleys of FIGS. 5–10 upwardly extends. FIG. 21 is a front view of switch 70 as trailing trolley 85 passes therethrough, illustrating both the vertical clearance between diverter pin 123 and the guide plates mounted to bottom plate section 274, and center diverter 113 being operatively engaged by flanges 307 and 308 to route the trailing trolleys to track path 285.

Figure 22:
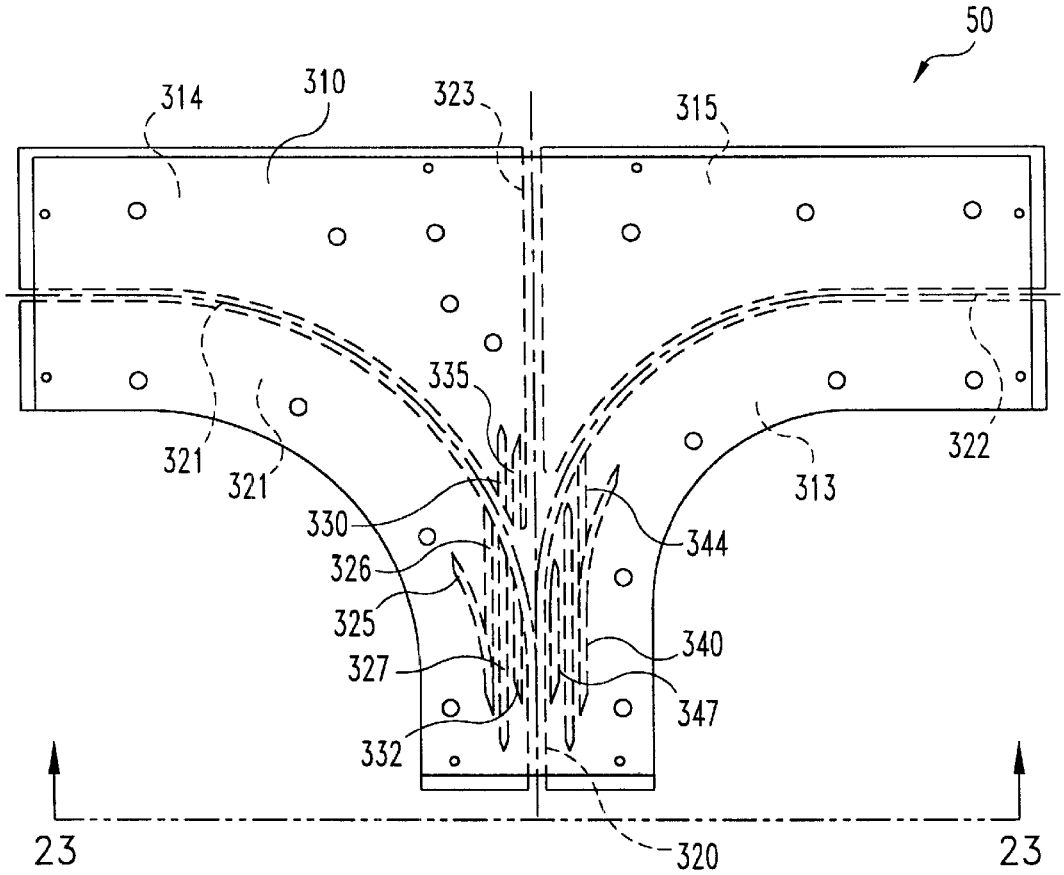
FIG. 22 is a top view of a first switch assembly from FIG. 2, shown removed from the remainder of the track, which serves to direct trolleys to the proper intersecting track sections during movement he suspended panels in a wall-forming direction.
Figure 23:
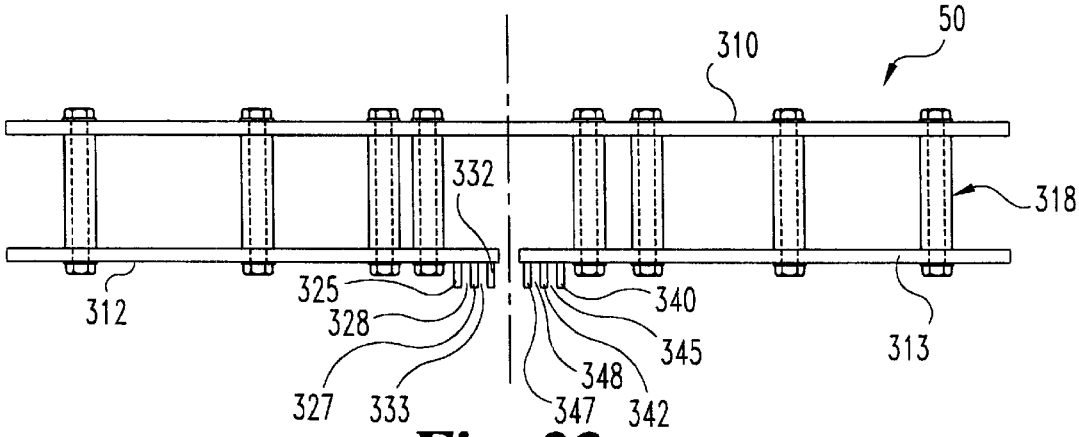
FIG. 23 is a rearview, taken along line 23—23 in FIG. 22, of the switch assembly of FIG. 22.

With reference now to FIGS. 22 and 23, the switch assembly 50 that during wall extension cooperates with the upstanding pins of the side diverter elements of the trolleys to route the trolleys to their proper track sections is shown in top view and rear view, respectively. Switch assembly 50 is formed from a single top plate 310, mounted in the room ceiling, and four bottom plate sections 312, 313, 314 and 315. Bottom plate sections 312–315 are each connected to top plate 310 in a vertical spaced-apart relationship by spacing fasteners indicated generally at 318.

Bottom plate sections 312 and 313 are horizontally spaced apart to provide a track path 320 into which enter trolleys being moved into switch assembly 50 along track section 26 in a forward or wall extending direction. Plate sections 312 and 314, and plate sections 313 and 315, are horizontally spaced apart to provide track paths 321 and 322, respectively, that are in communication with track path 320 and that have different radiuses of curvature similar to the track paths of switch 70. Plate sections 314 and 315 are horizontally spaced apart to provide a linear track path 323 in communication and aligned with track path 320. Track paths 321, 322 and 323 feed the trolleys moving therealong into the track paths of track sections 27, 28 and 29, respectively.

Guides used to selectively route trolleys passing along track path 320 into one of track path 321, 322 or 323 include an arrangement of guide plates fixedly mounted to the various bottom plate sections. In order to ensure engagement with the upstanding diverter pins of both the lead trolleys and the trailing trolleys, each guide plate on switch assembly 50 is sufficiently tall so as to project down from the bottom plate section to which it is attached to a height slightly below the tops of the shorter upstanding pins of the side diverter elements of the trailing trolleys. Plates of this standard height also naturally project below the tops of taller, upstanding pins of the side diverter elements of the lead trolleys.

Guide plate 325 serves to route trolleys moving along track path 320 into track path 321 in the process of forming a wall along track segment 27. Arcuate guide plate 325 is structured such that diverter pin 232 of trolley 230, and diverter pin 226 of trolley 220, slide along the laterally outer face of guide plate 325 to route trolleys 230 and 220 into track path 321. Straight guide plates 326 and 327 define a channel 328 through which slide diverter pin 212 of trolley 210 and diverter pin 206 of trolley 200. Guide plates 326 and 327 are structured to prevent trolleys 210 and 200 from entering track path 321 as the trolleys move forward in a wall extending direction along track path 320. Guide plate 330, which is aligned with guide plate 327, functions to prevent trolleys 210 and 200 from straying into track path 322, and thereby direct such trolleys into track path 323, by the engagement of diverter pins 212 and 206 against the laterally outward face of guide plate 330. Straight guide plate 332 and guide plate 327 together define a channel 333 through which slide diverter pin 192 of trolley 190 and diverter pin 186 of trolley 180. Guide plates 327 and 332 prevent trolleys 190 and 180 from entering track path 321 as the trolleys move forward in a wall extending direction along track path 320. Guide plate 335 is aligned with guide plate 332 and functions to prevent trolleys 190 and 180 from straying into track path 322, and thereby direct such trolleys into track path 323, by the engagement of diverter pins 192 and 186 against the laterally outward face of guide plate 335.

Guide plate 340 serves to route trolleys moving along track path 320 into track path 322 in the process of forming a wall along track segment 28. Guide plate 340 has an arcuate downstream end and is structured such that diverter pin 134 of trolley 130, and diverter pin 123 of trolley 85, slide along the laterally outer face of guide plate 340 to route trolleys 130 and 85 into track path 322. Straight guide plates 342 and 344, together with a straight segment of guide plate 340, define a channel 345 through which slides diverter pin 152 of trolley 150 and diverter pin 146 of trolley 140. Guide plates 340, 342 and 344 are structured to prevent trolleys 150 and 140 from entering track path 321 or track path 322 as the trolleys move forward in a wall extending direction along track path 320, to thereby route the trolleys into track path 323. Straight guide plate 347 and guide plate 342 together define a channel 348 through which slides diverter pin 172 of trolley 170 and diverter pin 166 of trolley 160. Guide plates 342 and 347 prevent trolleys 170 and 160 from entering track path 321 or track path 322 as the trolleys move forward in a wall extending direction along track path 320, to thereby route the trolleys into track path 323.

Figure 24:
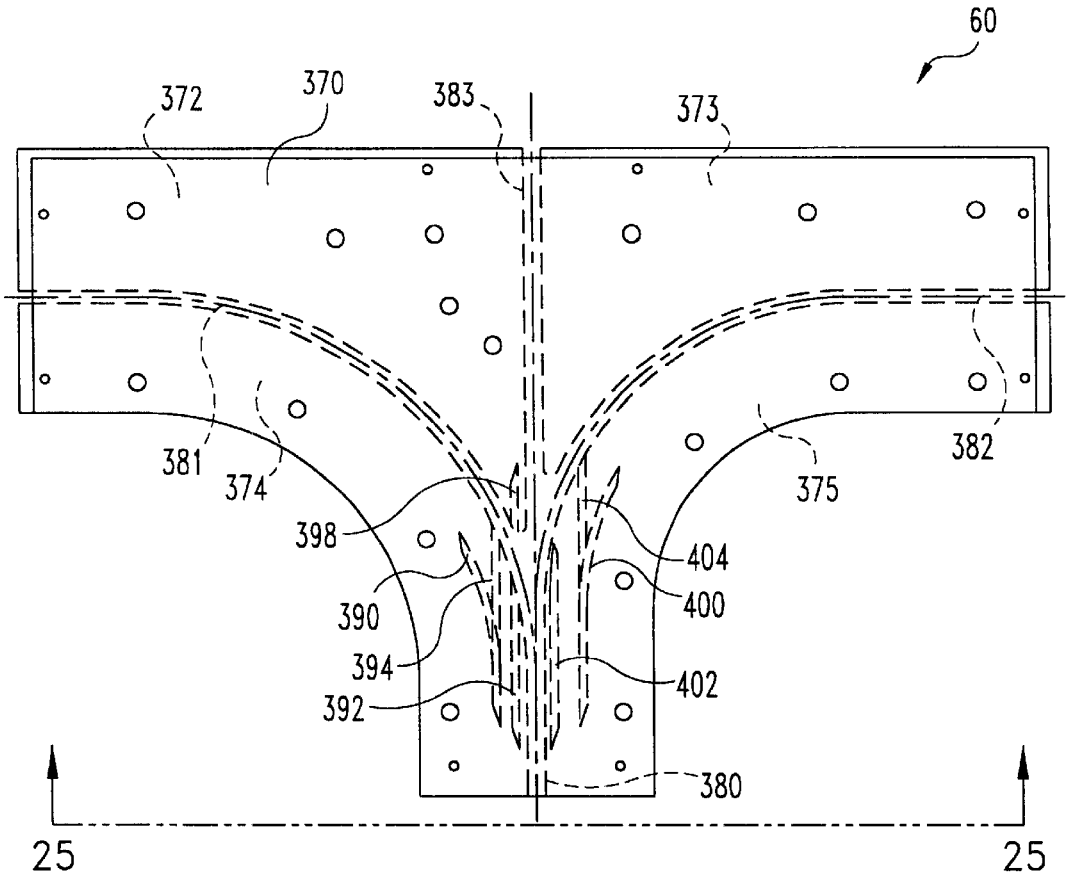
FIG. 24 is a top view of another switch assembly from FIG. 2, shown removed from the remainder of the track, which serves to direct trolleys to the proper intersecting track sections during movement the suspended panels in a wall-forming direction.
Figure 25:
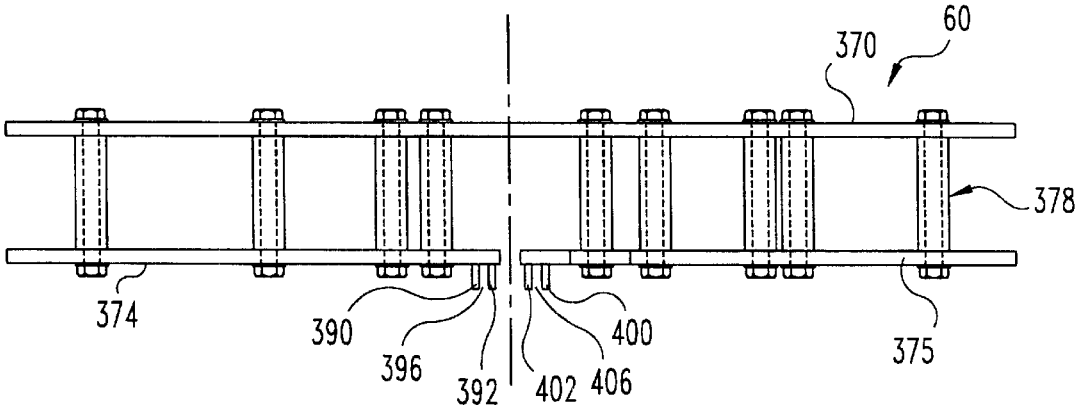
FIG. 25 is a rear view, taken along line 25—25 in FIG. 24, of the switch assembly of FIG. 24.

With reference now to FIGS. 24 and 25, the switch assembly 60 that during wall extension cooperates with the upstanding pins of the side diverter elements of the trolleys to route the trolleys to their proper track sections 30–32 is shown in top view and rear view, respectively. Except for its guide plate design, switch assembly 60 is constructed and mounted in a similar fashion to switch assembly 50 and includes top plate 370, bottom plate sections 372, 373, 374 and 375, and spacing fasteners 378.

Bottom plate sections 374 and 375 are spaced to provide track path 380. Plate sections 372 and 374, and plate sections 373 and 375, are horizontally spaced apart to provide track paths 381 and 382, respectively, with radiuses of curvature similar to the track paths of switch 50. Plate sections 372 and 373 are spaced to provide a linear track path 383 in line with track path 380. Track paths 380, 381, 382 and 383 are aligned with the track paths of track sections 29, 30, 31 and 32, respectively.

Guides used to selectively route trolleys passing along track path 380 into one of track path 381, 382 or 383 include guide plates fixedly mounted to the various bottom plate sections. The guide plates, although shown in FIG. 25 as having different heights, may be of the same height and are each sufficiently tall to engage the upstanding diverter pins of both the passing lead trolleys and the trailing trolleys. Arcuate guide plate 390 is structured such that diverter pin 212 of trolley 210, and diverter pin 206 of trolley 200, slide along the laterally outer face of guide plate 390 to route trolleys 210 and 200 moving along track path 380 into track path 381 in the process of forming a wall along track segment 30. Straight guide plates 392 and 394, together with a segment of guide plate 390, define a channel 396 through which slides diverter pin 192 of trolley 190 and diverter pin 186 of trolley 180. Guide plates 392 and 394 prevent trolleys 190 and 180 from entering track path 381 as the trolleys move forward in a wall extending direction along track path 380. Guide plate 398 is aligned with guide plate 392 and functions to prevent trolleys 190 and 180 from straying into track path 382, and thereby directs such trolleys into track path 383, by the engagement of diverter pins 192 and 186 against the laterally outward face of guide plate 398.

Guide plate 400 is structured such that diverter pin 152 of trolley 150, and diverter pin 146 of trolley 140, slide along the laterally outer face of guide plate 400 to route trolleys 150 and 140 moving along track path 380 into track path 382 in the process of forming a wall along track segment 31. Straight guide plates 402 and 404, together with guide plate 400, define a channel 406 through which slides diverter pin 172 of trolley 170 and diverter pin 166 of trolley 160. Guide plates 402 and 404 prevent trolleys 170 and 160 from entering track path 381 or track path 382, and route the trolleys into track path 383, as the trolleys move forward in a wall extending direction along track path 380.

The automatic track switching system of the present invention will be further understood in view of the following description of its operation. When the panels are in the stacked arrangement shown in FIG. 2, to compartmentalize room 20 the panels are first removed from housing 24 manually by a user who subsequently pushes or pulls the panel along the various track sections to a wall-forming position. In particular, when a panel of the type **22*a* is moved from its stacked arrangement, the engagement of its trolleys with the switch assemblies 70 and 80 causes panel 22*a* to be routed into track section 26. Upon reaching switch assembly 50, the above-described engagement of the guide plates mounted on the switch assembly with the upstanding pins of the side diverter elements of its trolleys cause panel 22*a* to pass through switch assembly 50 into track segment 29. When panel 22*a* reaches switch assembly 60, the engagement of the guide plates of the switch assembly with the upstanding pins of the side diverter elements of the trolleys automatically switches panel 22*a* into the track path which leads to track section 30**.

In a similar fashion, panels of the type **22*b* are routed via switch assemblies 70 and 80 into track section 26, through switch assembly 50 into track section 29, and are automatically routed by switch assembly 60 into track section 31. Panels of the type 22***c* are routed via switch assemblies 70 and 80 into track section 26, and are automatically routed by switch assembly 50 into track section 27. Panels of the type 22*d* are routed via switch assemblies 70 and 80 into track section 26, and are automatically routed by switch assembly 50 into track section 28. Panels of the type 22*e* and 22*f* are routed by switch assemblies 70 and 80 into track section 26, and, depending on the order in which they are moved from housing 24, such panels are aligned along track segments 32, 29 and 26.

The process of moving the panels back to a stacked arrangement is performed in generally the reverse order of the wall-forming process. As the panels traveling along track section 26 are moved rearward, the trailing trolleys enter the switch assembly 70. Because the shorter upstanding pins of the side diverter elements of the trailing trolleys do not vertically extend upward to engage the guide plates mounted on the underside of the bottom plates of assembly 70, the trailing trolleys are not affected by such guide plates. However, the center diverter disposed at the top of each trailing trolley engages the upper guide 305, thereby routing the trailing trolleys into track segment 72 and then ultimately to switch assembly 80. As the panels continue to move rearward, the guide plates of switch assembly 80 engage the upstanding pins of the side diverter elements of the trailing trolleys to route the trailing trolleys into the proper track section for stacking, and the guide plates of switch assembly 70 engage the upstanding pins of the side diverter elements of the lead trolleys to route the lead trolleys into the proper track section for stacking.

By utilizing diverter elements on the trolleys which are provided at different lateral spacings relative to the trolleys, it is possible to provide automatic track switching systems adaptable for use with a great variety of types of wall arrangements. Although trolleys with side diverter elements with three lateral pin positionings are shown, systems with fewer or possibly even greater lateral positionings are within the scope of the present invention.

Figure 26:
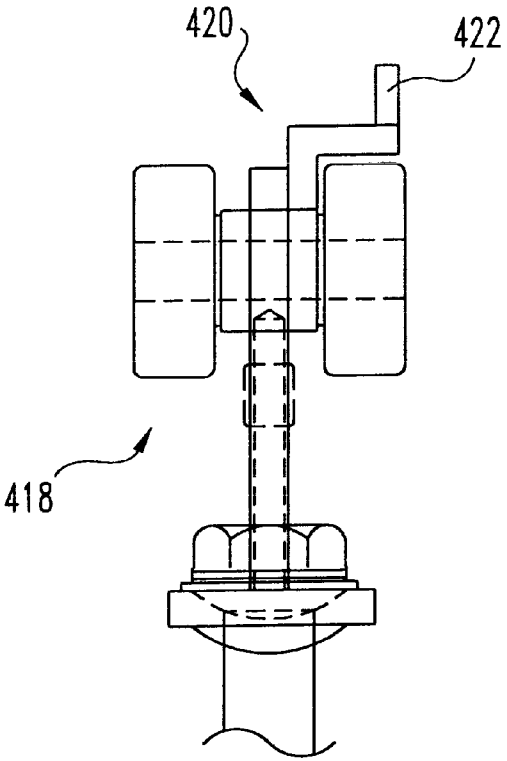
FIG. 26 is a front view of a trolley equipped with an alternate diverter element for a track switching system.

In an alternate embodiment of the present invention which may also be used with numerous track designs, rather than placing the guide plates on the underside of the bottom plate sections of the switch assembly, the series of guide plates are situated on the underside of the upper or top switch plate. The trolleys for this embodiment include diverter elements corresponding to the side diverter elements of the trolleys of FIGS. 5–16, but which are mounted to extend above the wheels of the trolley assembly. FIG. 26 is front view of one such lead trolley 418 including a side diverter element 420 with a standard height upstanding diverter 422. The diverter 422 is shown as a solid plate, but could be differently configured, such as a series of upstanding pins. As the trolley shown in FIG. 26 is a lead trolley, it therefore lacks a center diverter. A trailing trolley suitable for use with the lead trolley 418 in conjunction with a switching system analogous to that described with respect to FIG. 2 would include a center diverter, and would include a lower profile upstanding pin on its side diverter element.

Figure 27:
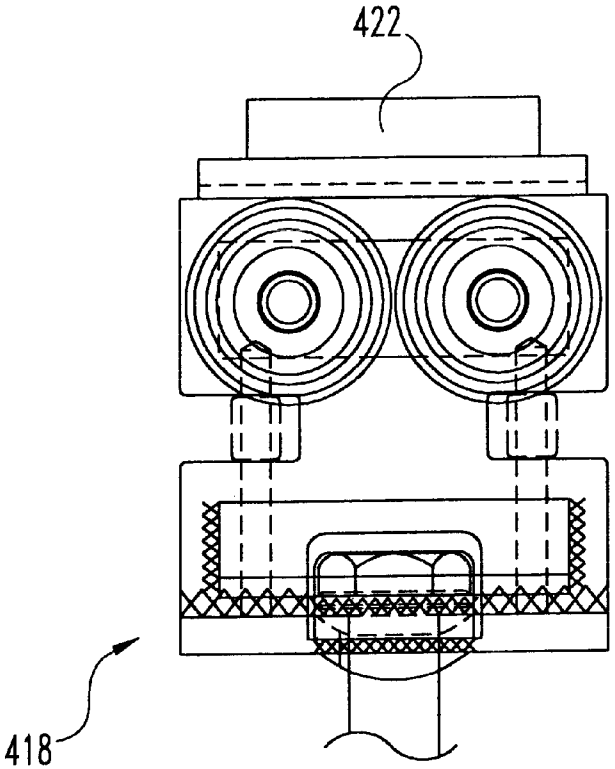
FIG. 27 is a left side view of the trolley of FIG. 26.

Furthermore, the diverter elements mounted on the top of the trolleys, as shown in FIGS. 26 and 27, may be used in conjunction with the side diverter elements of the trolleys of FIGS. 5 through 16. For example, in the event it was desired to further compartmentalize room 39 by providing a wall along the track section indicated in dashed lines 430, trolleys 200 and 210 for panel type 22*a* could be further equipped with an upstanding diverter element identical to diverter 420 in FIG. 26. The intersection of track sections 30 and 430 would then be provided with a switch assembly having a guide plate that downwardly extends from the underside of the top plate so as to be engaged by diverter plate 422 in order to divert certain panels traveling along track section 30 into track section 430.

Figure 28:
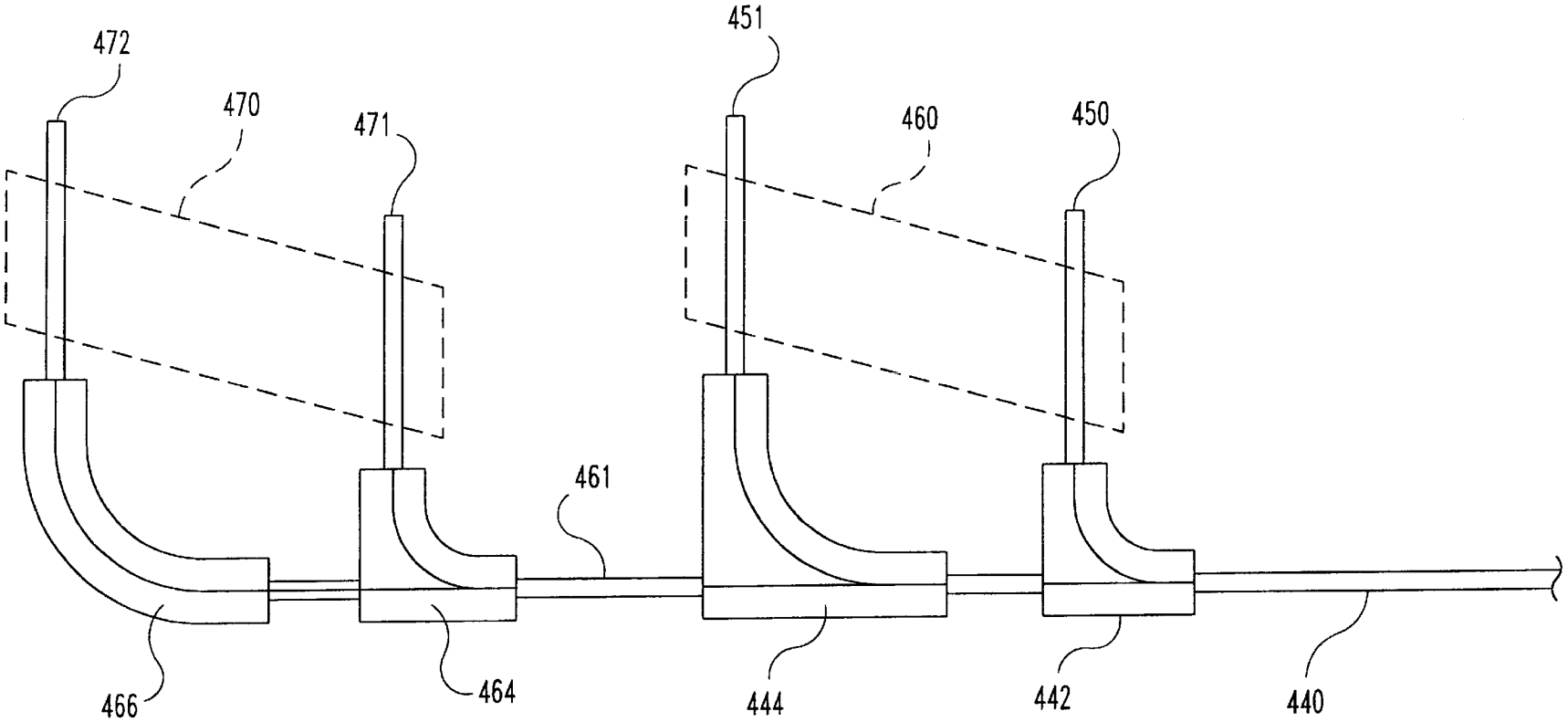
FIG. 28 is a partial, diagrammatic top view of the track of another operable wall that due to the use of the track switching system of the present invention is stacked on one side of the track at multiple locations without the use of an offset switch.

Although the side diverter elements of the embodiments of FIGS. 1–25 are shown as being provided on both sides of the various trolleys, the present invention may be advantageously utilized with side diverter elements only on a single side of the trolleys, and the panels all may be stacked on one side of the track. Moreover, the multitude of different side diverter element arrangements possible allows panels to be stacked at more than one location along the length of the track on the same side of the track. As shown in FIG. 28, the guide plate and trolley diverter element configuration of the present invention allows panels to be stacked at different longitudinal locations along the track without the need for offset switches presently typically utilized in the art. In this embodiment, the track 440 is provided with a pair of switch assemblies 442 and 444 that route panels moving on the track in a stacking direction to be automatically routed onto track sections 450 and 451. Panels of this type are shown in the stacked arrangement in dashed lines at 460. The other set of panels moves rearward through track section 461 and is automatically routed by switch 464 and track section 466 such that the panels, as shown in stacked arrangement in dashed lines at 470, are properly stacked along track sections 471 and 472.

While this invention has been shown and described as having multiple designs, the present invention may be further modified within the spirit and scope of this disclosure. For example, rather than using pins on the side diverter elements of the trailing trolleys which are shorter than the lead trolley pins, same length pins may be used if the horizontal flanges to which the pins are attached are lowered on the trailing trolleys. This application is therefore intended to cover any variations, uses, or adaptations of the invention using its general principles. Further, this application is intended to cover such departures from the present disclosure as come within known or customary practice in the art to which this invention pertains.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. An automatic track switching apparatus for a movable wall system having multiple wall panels supported by and movable along multiple paths defined by multiple track sections to predetermined configurations, the apparatus comprising:

a switch assembly at a junction between track sections defining a first path along one track section and at least second and third paths along at least two other track sections branching from said first path;

at least one guide member mounted on said switch assembly along said first path, said guide member being laterally offset relative to said first path; and at least two trolleys attached to and supporting each wall panel of the movable wall system, each of said trolleys including a support plate and a pair of bearing members rotatably positioned above said support plate, a trolley plate attached to and upwardly extending from said support plate, said trolley plate defining a relief notch for each of said bearing members, and a wall panel connecting member pivotably connected to and extending below said support plate, and each of said trolleys further including diverter means for selectively engaging said at least one guide member as each of said trolleys travels along said first path to route the supported wall panel along either said second or said third paths.

2. The automatic track switching apparatus according to claim 1, in which each of the track sections defines a channel, wherein:

said at least one guide member includes a guide plate extending vertically from said switch assembly;

each of said trolleys includes a wheel assembly configured to travel within the channel of each of the track sections; and said diverter means includes a vertically oriented pin laterally offset relative to the path defined by each track section.

3. The automatic track switching apparatus according to claim 2, wherein:

said at least two trolleys includes a lead trolley and a trailing trolley and said pin on one of said lead or trailing trolleys is taller than said pin on the other of said lead or trailing trolleys; and said guide plate has a height sized to be engaged only by the taller of said pins.

4. The automatic track switching system according to claim 2, wherein:

said guide plate is disposed a first lateral distance from said first path; and said at least two trolleys includes a lead trolley and a trailing trolley and said pin on one of said lead or trailing trolleys is disposed at said first lateral distance, while said pin on the other of said lead or trailing trolleys is disposed at a second lateral distance different from said first lateral distance.

5. An automatic track switching apparatus for a movable wall system having multiple wall panels supported by and movable along multiple paths defined by multiple track sections to predetermined configurations, the apparatus comprising:

at least one switch assembly at a junction between track sections defining a first path along one track section and at least second and third paths along at least two other track sections branching from said first path;

at least two guide members mounted on said at least one switch assembly along said first path, said guide members being laterally offset relative to said first path at different lateral distances relative to each other; and a plurality of paired trolley assemblies, each pair of said plurality of paired trolley assemblies attached to and supporting different wall panels of the operable wall, each of said trolley assemblies including a support plate and a pair of bearing members rotatably positioned above said support plate, a trolley plate attached to and upwardly extending from said support plate, said trolley plate defining a relief notch for each of said bearing members, and a wall panel connecting member pivotably connected to and extending below said support plate, and diverter means for selectively engaging said guide members as each of said trolley assemblies travels along said first path to route the supported wall panel along either said second or said third paths.

6. The automatic track switching apparatus according to claim 5, in which each of the track sections defines a channel, wherein:

each of said guide members includes a guide plate extending vertically from said switch assembly;

each of said trolley assemblies includes a wheel assembly configured to travel within the channel of each of the track sections; and said diverter means includes a vertically oriented pin laterally offset relative to the path defined by each track section, said pin for different ones of said trolley assemblies being offset at different lateral distances relative to each other for engaging said guide plate of selected ones of said at least two guide members.

7. The automatic track switching apparatus according to claim 6, wherein:

a first switch assembly includes at least two guide members in which said guide plate has a first height;

a second switch assembly includes at least two guide members in which said guide plate has a second height different from said first height;

said pin for said diverter means of selected ones of said trolley assemblies has a height sized to engage only said guide plate of said first switch assembly and not said guide plate of said second switch assembly; and said pin for said diverter means of remaining ones of said trolley assemblies has a height sized to engage said guide plate of both said first switch assembly and said second switch assembly.

8. An automatic track switching apparatus for a movable wall system having multiple wall panels movable along a track having multiple paths defined by multiple track sections between a predetermined stored arrangement and a predetermined wall forming arrangement, said apparatus comprising:

a switch assembly at a junction between track sections defining a first path along one track section and at least second and third paths along at least two other track sections branching from said first path;

at least one guide member mounted on said switch assembly;

a leading trolley and a trailing trolley attached to each wall panel, each said trolley including a wheel assembly supporting the wall panel on the track;

a first diverter element attached to each said leading and trailing trolley below said wheel assembly for selective engagement with said at least one guide member to route the wall panel through said switch assembly in a predetermined manner to and from said wall forming arrangement; and a second diverter element mounted above said wheel assembly of each said trailing trolley, said second diverter element selectively engaging said at least one guide member to control the movement of the wall panel when the wall panel is moved to said predetermined stored arrangement.

9. The apparatus of claim 8 wherein said first diverter elements are laterally offset and said second diverter element is centrally disposed.

10. The apparatus of claim 8 wherein said first and second diverter elements and said guide member cooperate to route the panels through said switch assembly without manual intervention.

* * * * *